United States Patent [19]

Davis et al.

[11] 4,277,191

[45] Jul. 7, 1981

[54] PRINTER SYSTEM HAVING MICROPROCESSOR CONTROL

[75] Inventors: Glenn W. Davis, Endicott, N.Y.; Arthur E. Fleek, Cary, N.C.

[73] Assignee: International Business Machines Corporation, Armonk, N.Y.

[21] Appl. No.: 115,850

[22] Filed: Jan. 28, 1980

[51] Int. Cl.[3] ..... B41J 11/42

[52] U.S. Cl. ..... 400/582; 400/583; 364/900; 364/111

[58] Field of Search ..... 101/93.14, 93.29, 111; 400/582, 583, 583.1, 155, 616, 616.1, 616.2, 616.3; 364/111, 116, 518, 519

[56] References Cited

U.S. PATENT DOCUMENTS

| | | | |
|---|---|---|---|
| 3,777,128 | 12/1973 | Kirkham | 364/111 X |
| 3,958,224 | 5/1976 | Boyd et al. | 400/583 X |
| 3,963,110 | 6/1976 | Hyland et al. | 400/582 |
| 4,085,837 | 4/1978 | Takano et al. | 400/583 |
| 4,146,922 | 3/1979 | Brown et al. | 364/118 |
| 4,153,945 | 5/1979 | Actor et al. | 364/900 |

OTHER PUBLICATIONS

Hays et al., IBM Tech. Discl. Bulletin, vol. 22, No. 1, Jun. 1979, pp. 269-271.

*Primary Examiner*—Edward M. Coven
*Attorney, Agent, or Firm*—John S. Gasper

[57] ABSTRACT

A control system for the carriage drive of a line printer includes a microprocessor which controls a carriage drive stepper motor through programmable timers and interface adapter along with other non-print units of a printer mechanism. A control counter in the carriage drive responsive to feedback pulses from the stepper motor coacts with the timers to control various operation of the stepper motor during line feeding of a print medium and is used by the microprocessor for preventing loss of control of the carriage drive due to interrupts from other devices.

10 Claims, 10 Drawing Figures

PRINTER SYSTEM HAVING MICROPROCESSOR CONTROL

TECHNICAL FIELD

This invention relates to a printer system having microprocessor control and particularly to microprocessor control of the carriage drive therefor.

CROSS-REFERENCE TO RELATED APPLICATION

The following copending application is cross-referenced and incorporated herein.

Application of R. D. Bolcavage, A. J. Ferraro and A. Fleek entitled "Belt Printer Control Architecture", Ser. No. 115,856, filed on Jan. 28, 1980.

BACKGROUND ART

In the related application the printer system includes a control using two independently operating microprocessors. One microprocessor is dedicated to the operation and control of the printing unit while the other microprocessor controls the operation of the carriage drive, ribbon drive and other non-printing units. The non-printing units are controlled by the microprocessor through an interface or control elements which are programmable for operation in accordance with the distinctively different operational patterns of the non-printing units. Communication between the microprocessor and the non-print units as well as other operating elements of the printer control system is through a system of interrupts each unit or its control having an assigned interrupt level. Normally the microprocessor gives priority for handling the control requirements to the higher level interrupt. However, certain functions on lower levels must be completed in their entirety before a higher level function regains control of the microprocessor. Such a condition might occur when ribbon drive reversal occurs. In that event, the ribbon drive interrupt preempts the microprocessor until reversal control has been initiated. In that event, a conflict can develop and certain conditions requiring satisfaction to the higher level unit can become lost resulting in a malfunction of the higher level unit.

SUMMARY OF THE INVENTION

It is the purpose of this invention to provide a microprocessor operated control system for a carriage drive which avoids this problem. Specifically, the control system for the carriage drive comprises programmable timers and an adapter which form an interface to a drive means such as a stepper motor. An emitter associated with the drive means generates feedback pulses which are connected to the microprocessor via interrupts from the adapter for controlling and monitoring the operation of the drive means. A counter controlled by the microprocessor counts feedback pulses. A control counter counts feedback pulses independently of the microprocessor. Periodic comparison during drive means operation is made of the two counters to determine whether the microprocessor missed a feedback pulse as a result of an interrupt from another device. The periodic comparison is made preferably as part of an END routine associated with acceleration, deceleration and velocity operations of the drive means. In the event a feedback pulse was missed, the microprocessor proceeds into a LOOP routine to correct its feedback pulse counter before continuing with further control of the drive means.

Thus, a control for a printer carriage drive is provided which can be operated real time and in a closed loop mode without affecting the precision in the operation of the carriage drive for feeding a print medium.

The foregoing and other features and advantages of the invention will be apparent from the following more particular description of preferred embodiments of the invention, as illustrated in the accompanying drawings.

BEST MODE FOR CARRYING OUT THE INVENTION

Description of the Printer System Control

Figure 1:
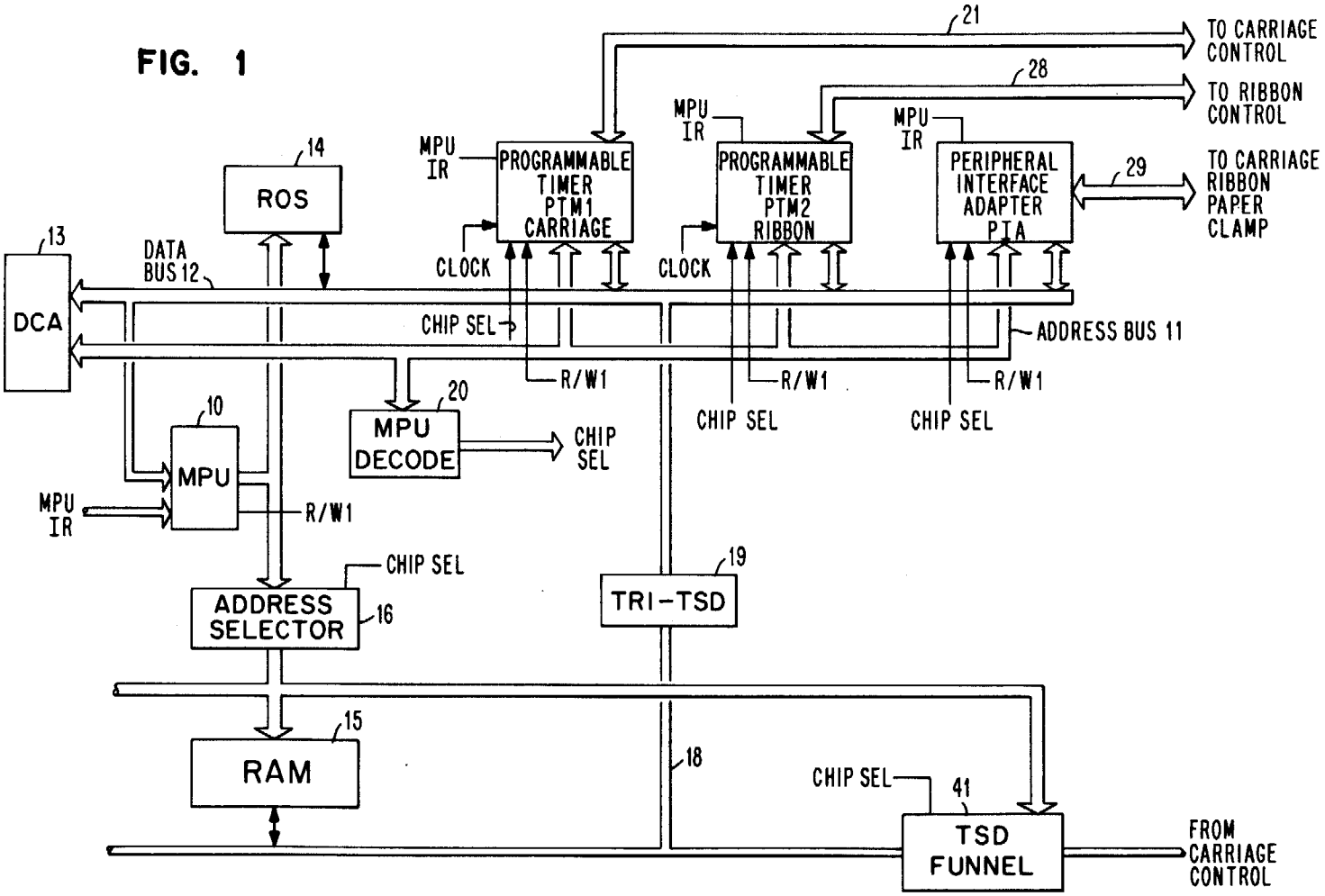
FIG. 1 is a schematic diagram of a portion of a microprocessor controlled printer system.
Figure 2:
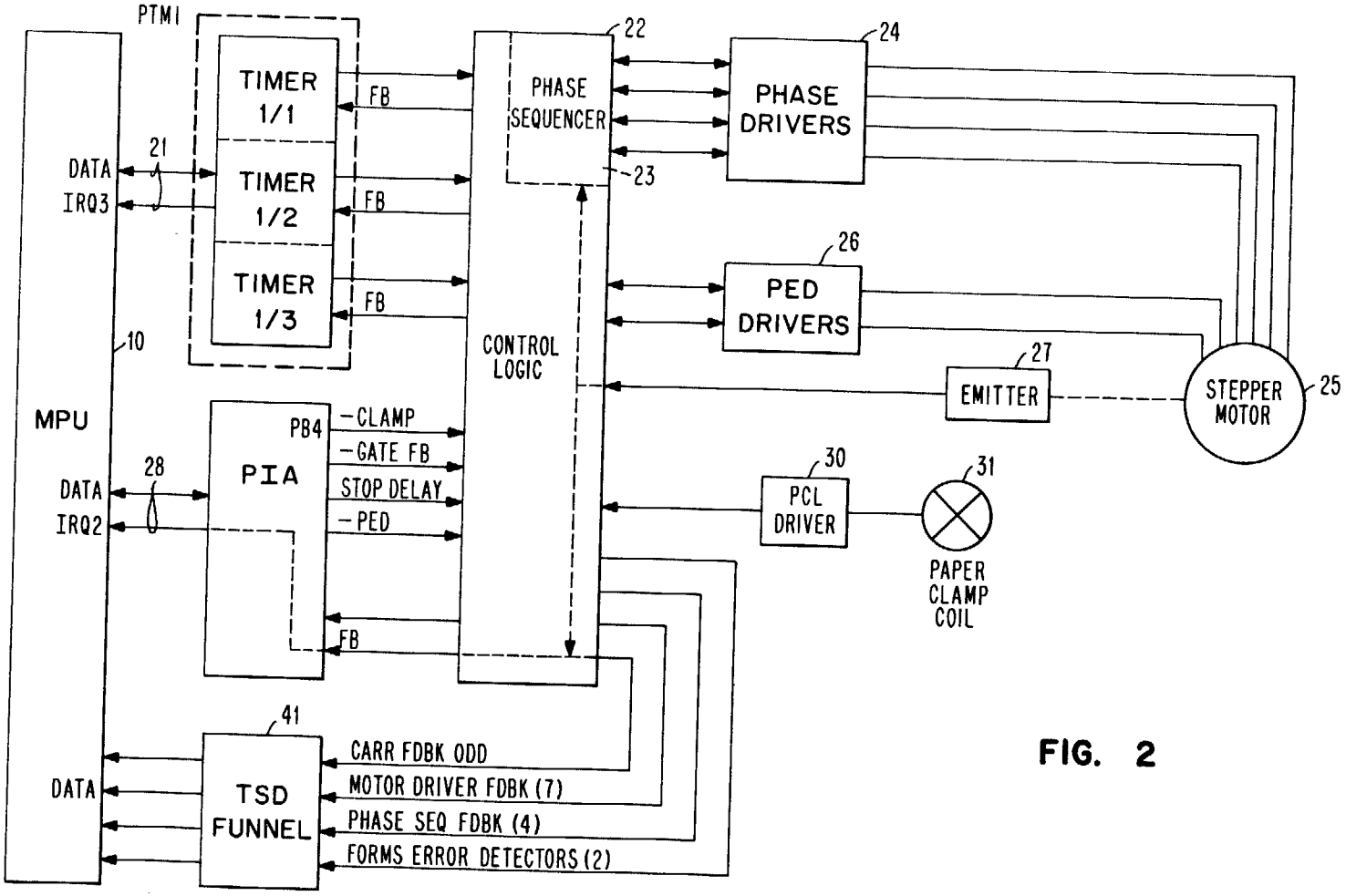
FIG. 2 is a schematic diagram of the carriage control portion of FIG. 1.

As seen in FIGS. 1 and 2 the printer system control includes a microprocessor unit MPU 10 connected by dedicated address and data busses 11 and 12 to programmable timers PTM 1 and PTM 2 and a peripheral interface adapter PIA as well as to data communications adapter DCA 13. Address and data busses 11 and 12 also connect MPU 10 to ROS 14 where the microcode resides for all processing procedures performed by MPU 10 including receiving printing and control data from a host system to be stored in a random access memory RAM 15. MPU 10 accesses RAM 15 for storage and retrieval of data via address selector 16 and address bus 17. Data is retrieved from RAM 15 on Data Bus 18 connected through Tri-State Device 19 to Data Bus 12. Also connected to the dedicated address bus 11 is MPU decode 20 which generates the various gating CHIP SEL pulses for MPU 10 to selectively access DCA 13, RAM 15, PTM 1, PTM 2 and PIA as well as other I/O devices as more fully described in the previously mentioned cross-referenced application.

PTM 1 is connected to the carriage control by Bus 21. The carriage control as seen in FIG. 2 comprises control logic 22 which includes phase sequencers 23 connected to phase drivers 24 of stepper motor 25. Carriage control also includes pedestal drivers 26 for the stepper motor 25. An emitter 27 connected to stepper motor 25 generates feedback pulses FB in known manner in the course of stepper motor rotation. As shown in FIG. 2, feedback pulses FB are sent through control logic 22 for use and connection to the system.

PTM 2 is connected by Bus 30 to a ribbon control (not shown) which comprises ribbon drive decode and ribbon motor drivers for right and left stepper motors. PTM 2 supplies ribbon advance and ribbon drive degate signals to ribbon drive decode for applying phase and pedestal signals to the motors for bidirectional ribbon feeding. Further details of the ribbon drive and its operation may be seen by reference to the cross-referenced application of Bolcavage, et al.

PIA is operated by MPU 10 to send and receive control signals to both carriage and ribbon drives as well as to other mechanisms including a paper clamp. Bus 29 contains the control and feedback lines for that purpose. As seen in FIG. 2 only those signals are shown which relate to carriage control and clamp operation. The clamp signal is sent through control logic 20 to paper clamp driver PCL 30 to paper clamp coil 31. Stepper motor 25 is operated by combination of control signals from PTM 1, PIA sent through control logic 22 under direction and control of MPU 10.

Also included in the printer control system is TSD funnel 41 addressable by MPU 10 for gating control and other signals from the carriage control and PIA to MPU 10 on data bus 18.

CARRIAGE DRIVE CONTROL

As previously discussed, the carriage drive control comprises the combination of MPU 10, PTM 1 and portions of PIA along with assorted control logic as described. Basically, PTM 1 comprises three timers 1/1, 1/2 and 1/3. PTM 1 also includes control logic for decoding commands and addresses from MPU 10 for setting the timers. Each timer is settable on command from MPU 10 to generate a timing pulse after a selected time interval or to time an operation of the carriage drive. The timers are basically counters which count timing pulses from a system clock. At the end of certain timing operations interrupt requests IRQ 3 are sent to MPU 10 for the purpose of performing various routines used for carriage drive control. Each timer is essentially one section of a programmable timer such as the Motorola MC6840 described in the Motorola publication entitled "The Complete Motorola Microcomputer Data Library" at pages 1-107 et seq.

Figure 3:
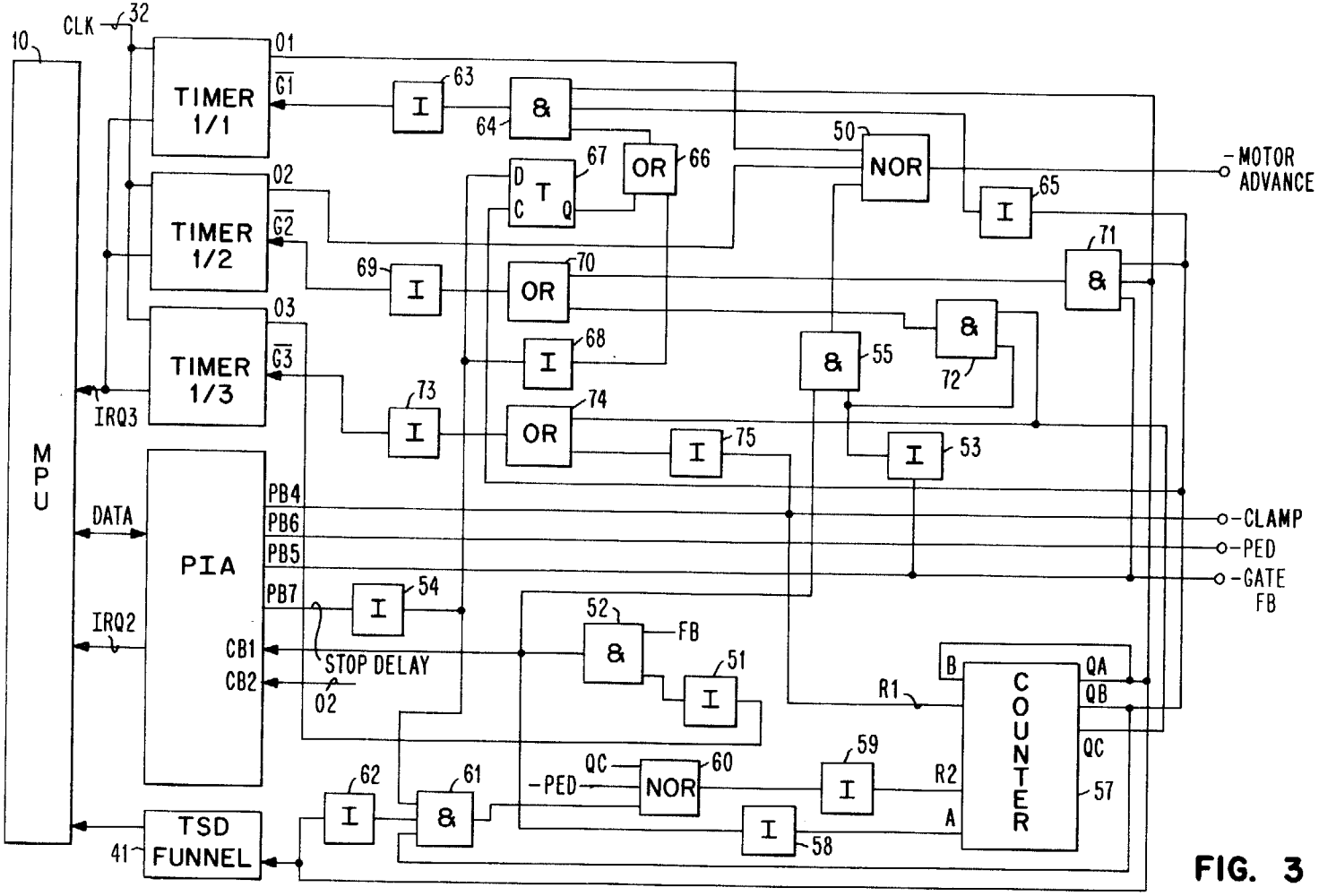
FIG. 3 is a circuit diagram showing details of the carriage control logic portions of FIG. 2.

As shown in FIG. 3 the elements of the carriage drive control and their functions may be broken down as follows:

1. Timer 1/1. Times 4 ms for paper clamp deactivation. Produces the first motor advance pulse 33 (see FIG. 4) and the first motor stop pulses 34 on output 01 to NOR 50.
2. Timer 1/2. Checks acceleration time, carriage-too-fast when up to speed, and produces the second motor stop pulses 35 (via output 02 to NOR 50).
3. Timer 1/3. Blocks motor feedback pulses for one millisecond after the first motor advance from timer 1/1 to inhibit feedback errors caused by carriage vibration and rocking. The circuit connection is from output 03 through I 51 to AND 52. This timer also checks carriage-too-slow when motor is up to speed, the 8 millisecond paper clamp timing and does deceleration checking when stopping the carriage.
4. PIA. Produces the control signals to operate the control logic 22 that receives the motor feedback FB pulses to allow MPU 10 to count FB pulses during carriage motion. The control lines set on command to PIA from MPU 10 are:
   - —CLAMP. On line PB 4. This signal 36 (see FIG. 4) turns PCL driver 30 ON or OFF to operate paper clamp coil 31 to hold and release the print medium.
   - —PED. On line PB 6. This signal 37 (see FIG. 4) is used by carriage control 22 to activate the pedestal drivers 26.
   - STOP DELAY. This signal 38 is used to delay the control logic for correct timing of the motor stop pulses from timers 1/1 and 1/2 during deceleration when the number of motor advances to be performed is not a multiple of 4.
   - —GATE FB. This signal 39 (see FIG. 4) on line PB 5 to I 53 is used to gate FB pulses 40 from AND 52 through AND 55 to NOR 50.

FB pulses are received by PIA from AND 52 at PORT CBl. PIA decodes the feedback signals and generates a level 2 interrupt IRQ 2 to MPU 10. Further details of the construction and operation of PIA may be seen by reference to previously mentioned Motorola publication for the peripheral interface adapter MC 6821 at pages 1-90 et seq.

5. Counter 57. This is a settable binary counter which tracks carriage movement by counting feedback $\overline{FB}$ pulses and is used for gating reset pulses $\overline{G1}$, $\overline{G2}$, and $\overline{G3}$ to timers 1/1, 1/2 and 1/3 of PTM 1 for the purposes of controlling acceleration, velocity and speed checking and operating the stop functions. FB pulses are supplied to counter 57 from AND 52 to I 58 to counter input A. Counter 57 is resettable at counts of 2 or 4 by signals applied to inputs R1 and R2. A-CLAMP signal from line PB 4 of PIA to counter input R1 blocks the counter 57 when paper clamp has not been released and the pedestal is inactive. A signal at R2 from I 59 and NOR 60 limits the output of Counter 57 to a count of 4. NOR 60 has inputs from AND 61 connected to output QB, through I 62 to QA and to I 54 which receives a STOP DELAY signal from PIA on PB 7. NOR 60 also receives a —PED signal from line PB 6 of PIA and from output QC of Counter 57.

As previously stated, timers 1/1 and 1/2 operate to apply stop pulses to the carriage drive. Timer 1/1 after a fixed interval applies the first stop 34 (see FIG. 4) upon receipt of a signal at $\overline{G1}$ through I 63 from AND 64. Inputs to AND 64 are from QA of Counter 57, and from QB of Counter 57 through I 65. The third input to AND 64 is from OR 66 having inputs from the output of trigger 67 and I 68 which is connected to I 54. Trigger 67 is set by a STOP DELAY signal 38 from PIA on PB 7 through I 54. Trigger 67 is switched on by a signal from output QB (count 2) of counter 57.

After a fixed interval, timer 1/2 sends the second stop pulse 35 upon appearance of a gate signal at $\overline{G2}$ received through I 69 from OR 70. A first input to OR 70 is from AND 71 which has input connections from QA and QB (count 3) of Counter 57 and from line PB 5 of PIA through I 53. A second input to OR 70 is from AND 72 which has inputs from line PB through I 53 of PIA and from output QC of Counter 57.

Timer 1/3 has gate $\overline{G3}$ connected through I 73 from OR 74 which has inputs from QC (count 4) of 57 counter and PB 4 of PIA through I 75. This arrangement permits timer 1/3 to perform the specified velocity checking and other operations associated with deceleration and paper clamping.

6. Tri-State Funnel 41. This provides the interface to MPU 10 for reading the state of various I/O devices such as end-of-forms switch and forms hold sensors. It also provides feedback of the status of counter 57 on command from MPU 10 for comparison with FB pulse counts stored in the FB pulse counter of RAM 15 by MPU 10. When addressed, the TSD Funnel 41 looks at the state of the binary counter 57 based on command from MPU 10. Specifically, Tri-State Funnel reads the condition of the output QA of the binary counter 57 to determine whether any FB pulses were not received i.e. missed by the MPU 10 during the period of processing another higher level interrupt.

CARRIAGE DRIVE CONTROL SYSTEM—DETAILED OPERATION

Figure 5:
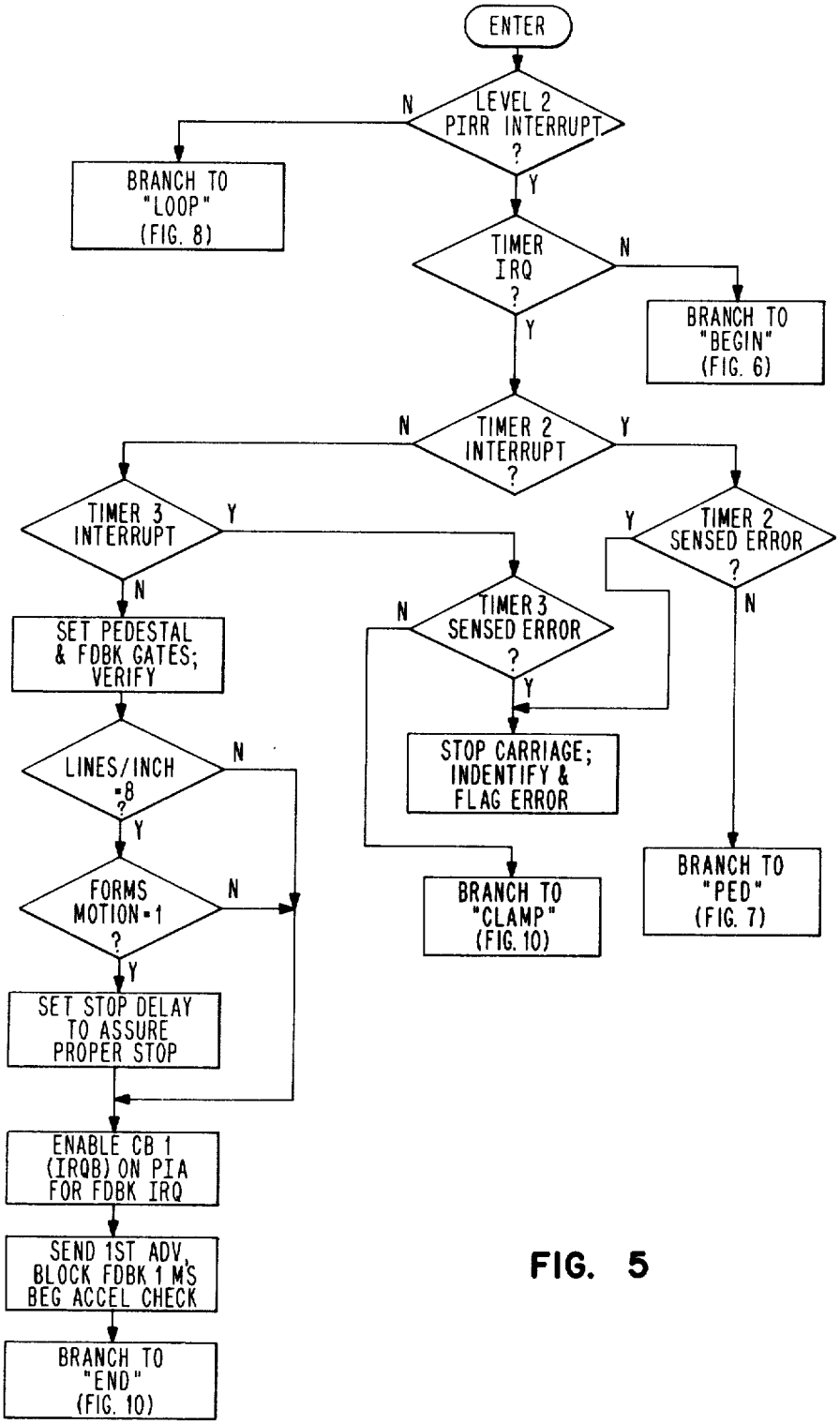
FIG. 5 is a flow diagram showing the ENTER routine for the microprocessor.
Figure 6:
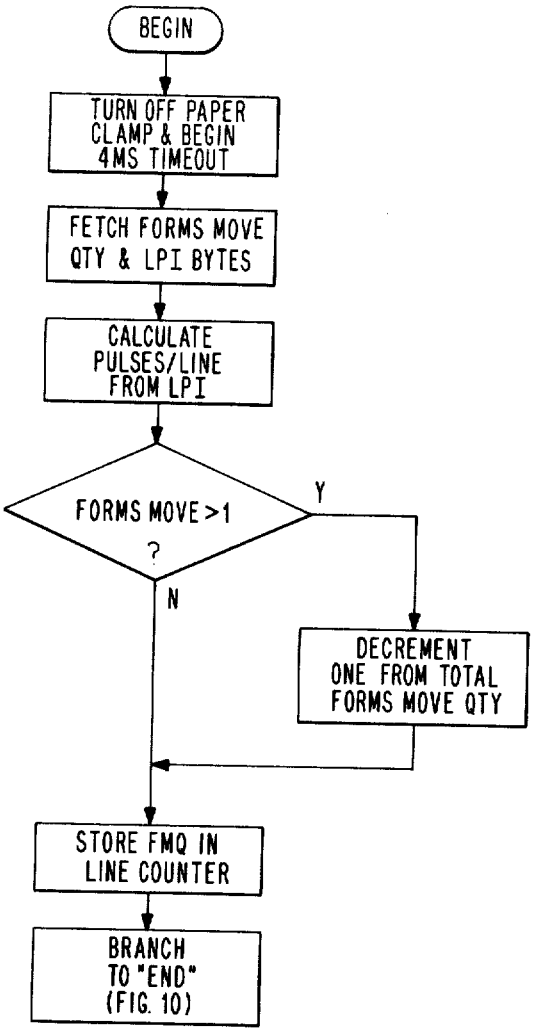
FIG. 6 is a flow diagram showing the BEGIN branch routine.

Carriage Drive Operations begins with MPU 10 receiving a level 2 program interrupt request PIRR which indicates forms motion. Such interrupt may occur from various sources including the second microprocessor (not shown) in the cross-referenced application of Bolcavage, et al. With this interrupt MPU 10 proceeds to the ENTER routine shown in FIG. 5 which begins with a check of the timers of PTM 1. Since none of the timers were active, MPU 10 branches immediately to the BEGIN routine in FIG. 6.

In processing the BEGIN routine, MPU 10 first turns off the paper clamp. This is done by command to the PIA which drops the clamp signal 36 (see FIG. 4) on line P84 to the PCL driver 30 which de-energizes paper coil 31. MPU 10 then sets timer 1/1 to begin a four millisecond time out. This time interval permits the clamp to disengage and settle out. This operation is done by command to PTM 1 which sets a counter and GATES timing pulses on line 32 from the system clock to the timer counter.

MPU 10 then processes the forms move quantity FMQ and line per inch LPI data which were previously stored in the MCB in RAM 15 and calculates the number of feedback pulses required for the forms move and stores the count in registers in RAM 15 indicating line count and pulses per line. If the forms move is greater than one line space, as indicated by FMQ, MPU 10 first decrements one from FMQ and stores in a line counter in the RAM register. MPU 10 then branches to the END routine in FIG. 10 which is part of the LOOP routine of FIGS. 7–10.

Figure 10:
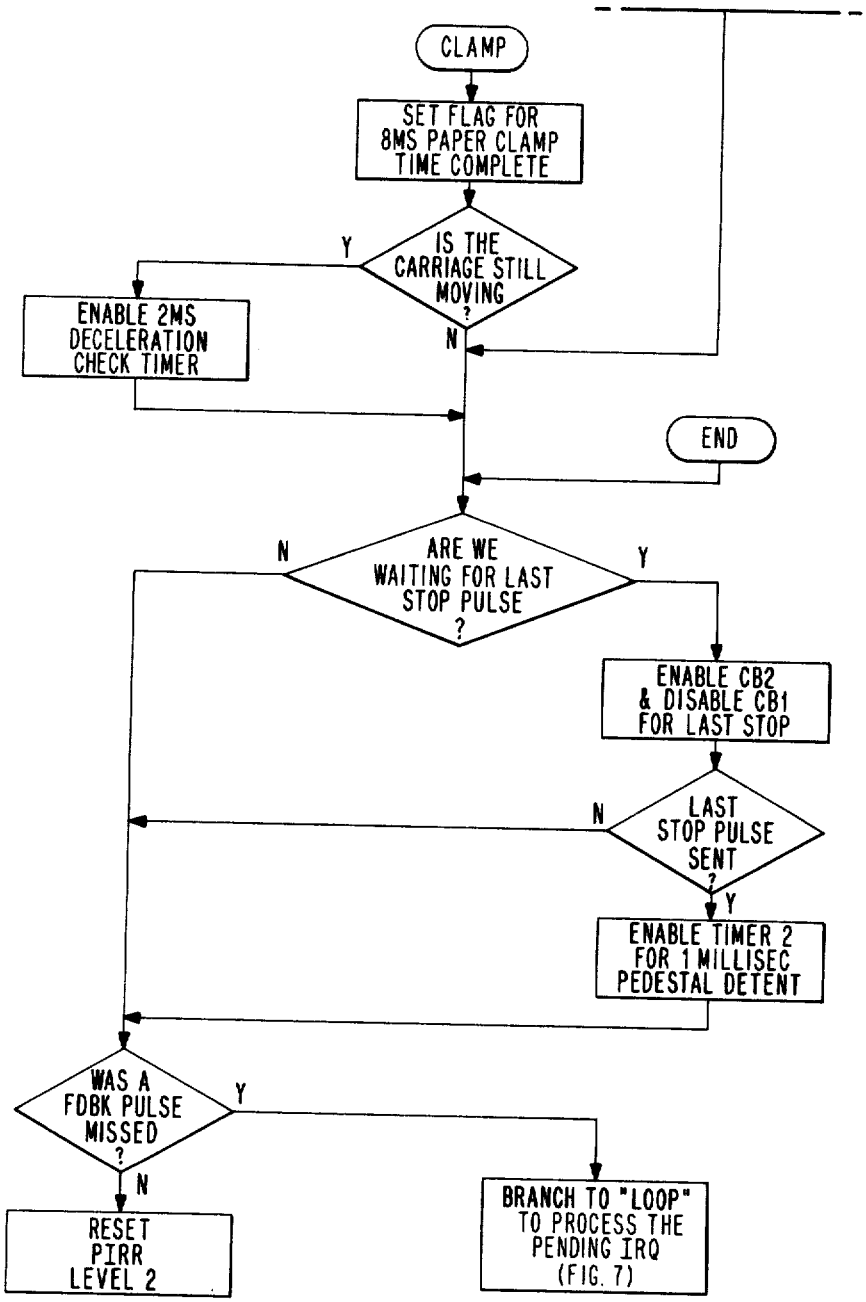

In the END routine as seen in FIG. 10 MPU 10 determines whether forms motion is in the deceleration phase. Since motion has not yet begun, MPU 10 proceeds to immediately reset PIRR level 2 and waits for the next interrupt request.

The next interrupt request occurs when timer 1/1 times out after four milliseconds and sends an IRQ 3 interrupt to MPU 10. This interrupt is recognized by MPU 10 as a forms motion interrupt and proceeds to the ENTER routine. This time MPU 10 again checks the timers and receives a yes; and, if no errors, MPU 10 proceeds to set the pedestal and feedback gate. Both of these are done by commands sent to PIA which turns on the pedestal (PED) signal 37 and Gate feedback signal 39 (see FIG. 4). The pedestal signal 37 is sent through the control logic 22 to the pedestal drivers 26 of the stepper motor 25.

MPU 10 determines the lines per inch and forms motion and sets the stop delay if motion is to be one line space to assure the proper stop. This is done by command to PIA which issues a STOP DELAY signal 38 as shown in FIG. 3. GATE feedback is set through PIA to enable PIA for receiving FB pulse interrupt requests IRQ 2 at CB 1 port. This establishes a closed loop mode of operation until FB GATE is deactivated. Such requests when received at CB 1 are recognized as level 2 interrupt requests for branching to the LOOP routine beginning at FIG. 8.

MPU 10 then sends the first motor advance pulse and blocks FB pulses to PIA for one millisecond and proceeds to begin the acceleration check. The first motor advance pulse is generated by command to PTM 1 which activates timer 1/1 to generate the first motor advance 33 (see FIG. 4) at terminal 01 through NOR 50 for application to the motor drivers which control the phase windings of the stepper motor 25.

MPU 10 blocks the FB pulses for one millisecond to PIA by command to PTM 1 which sets the counter in timer 1/3 and sets a blocking signal at 03 to AND 52 in FIG. 3.

MPU 10 begins the acceleration check by command to PTM 1 which sets the counter of timer 1/2 for a six millisecond count interval. MPU 10 having done all these then branches to the END routine and again proceeds immediately to reset PIRR level 2 to wait for additional interrupt requests.

Neither timer 1/1 after generating the first motor advance pulse 33 nor timer 1/3 after the one millisecond time out will generate an interrupt request. The next interrupt seen by MPU 10 will be from PIA in response to the first FB pulse, after the blocking interval, applied to CB 1. MPU 10 upon receipt of this feedback request IRQ 2 resets the interrupt request gate CB 1 in PIA and initiates the LOOP routine beginning in FIG. 8. MPU 10 updates the feedback pulse counter in RAM 15 and performs various technical operations as shown in the LOOP routine. In the course of this routine MPU 10 if acceleration is proceeding properly will have received a second FB pulse before timer 1/2 times out. MPU determines whether a second feedback pulse has occurred by checking the status of the line and feedback counters in RAM 15 and disables timer 1/2 as shown at 80 in FIG. 8 thereby terminating the acceleration check and preventing the generation of an IRQ 3 by timer 1/2. MPU 10 then checks the forms motion FMQ counter in RAM to determine if it is greater than 2. If so, it then proceeds to set timers 1/2 and 1/3 for performing the velocity checks. Should the timer 1/2 generate an interrupt request after the six millisecond time out having not been disabled by MPU 10, MPU 10 ceases further processing of the LOOP routine and proceeds to the ENTER routine where the timers are again checked. In this event, a check of timer 2 indicates an error since no interrupt request was expected and MPU 10 then proceeds to stop the carriage and identify and flag the error.

Figure 4:
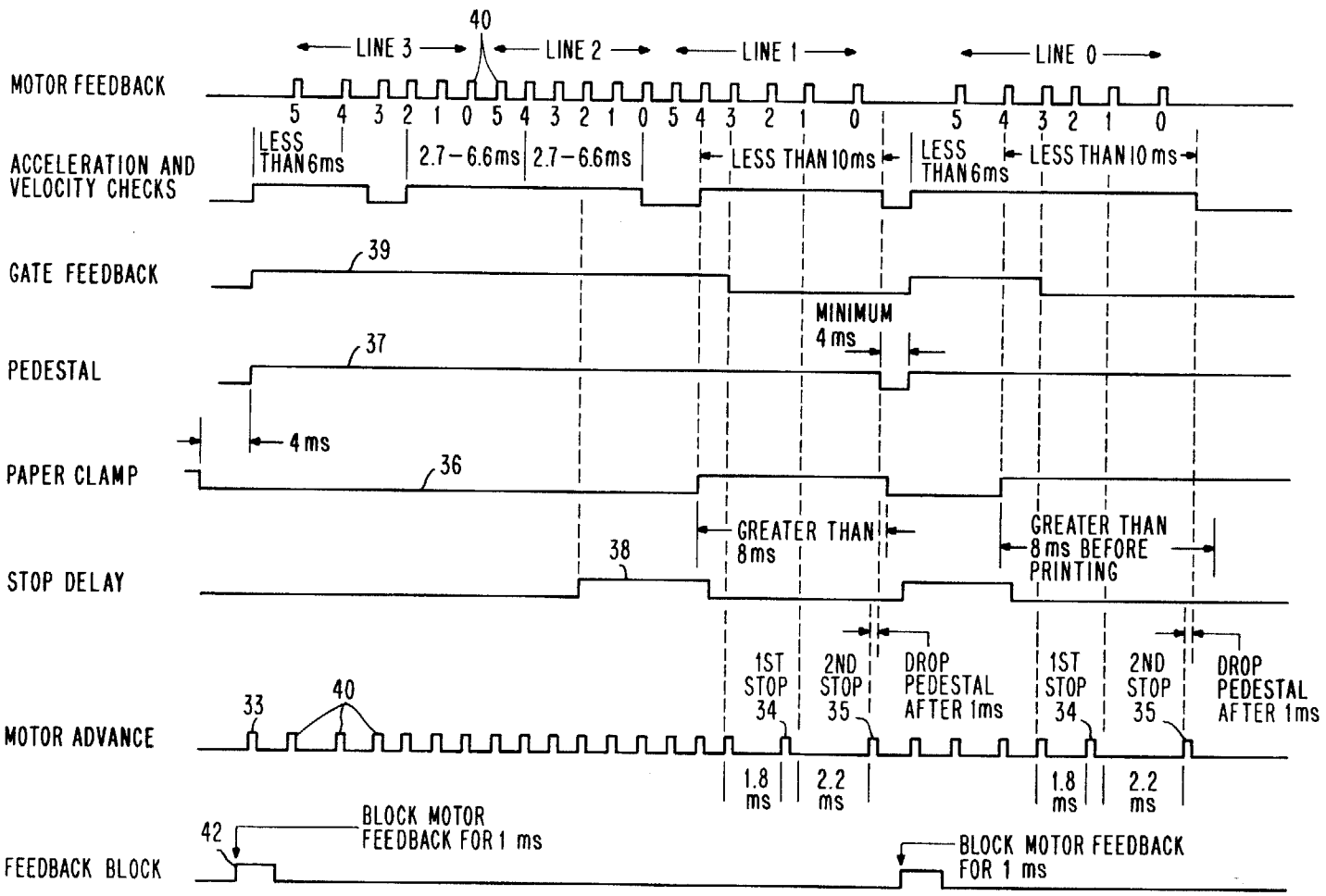
FIG. 4 is a timing chart showing the various control signals used by the control system for carriage drive control.

As the LOOP routine proceeds, assuming error-free operation in the acceleration of the stepper motor, MPU 10 continuously monitors the status of its feedback count register in RAM 15. When the feedback pulse count is less than 6 as shown at 81 in FIG. 9 MPU 10 enables the timer 1/1 to generate the first clock stop pulse to begin deceleration. This is done by command to PTM 1 to count system pulses for 1.8 milliseconds after $\overline{GI}$ has been activated by counter 57 outputs QA and QB through AND 64 as shown in FIG. 4. MPU 10 then checks its pulse counter for less than five feedback pulses then sets the paper clamp and the 8 millisecond time out and resets STOP DELAY. When the feedback pulse count in the RAM register is less than 4, MPU 10 deactivates the GATE feedback to PIA to terminate closed loop operation and then sets timer 1/2 to count clock pulses for a 2.2 milliseconds interval after $\overline{G2}$ has been activated by counter 57 through AND 71 to generate the second stop pulse 35. MPU 10 then proceeds with the END routine which enables PIA GATE CB 2 and disables CB 1 for the last stop pulse. When the last stop pulse 35 has been sent, MPU 10 enables timer 1/2 for a 1 millisecond pedestal detent. MPU 10 then checks for missing feedback pulse. If none, MPU 10 resets PIRR to level 2 and waits for the interrupt from timer 1/2 after the 1 millisecond time out. Upon receipt of the 1 millisecond time out from timer 1/2 MPU 10 then proceeds through the ENTER routine which ends up in a branch to the CLAMP routine.

As seen in FIG. 10 MPU 10 in the CLAMP routine sets a flag for the 8 millisecond paper clamp time complete, checks for carriage motion and, if yes, enables a 2 millisecond deceleration check timer. This is done by setting timer 1/3 to gate clock pulses for a 2 millisecond time interval. This meets the constraint for a maximum of ten milliseconds for carriage to come to a complete stop. An interrupt from timer 1/3 after this interval indicates an error in ENTER routine which stops carriage and flags error. MPU 10 then proceeds to the END routine and resets PIRR level 2 if no missing pulse was detected.

Figure 7:
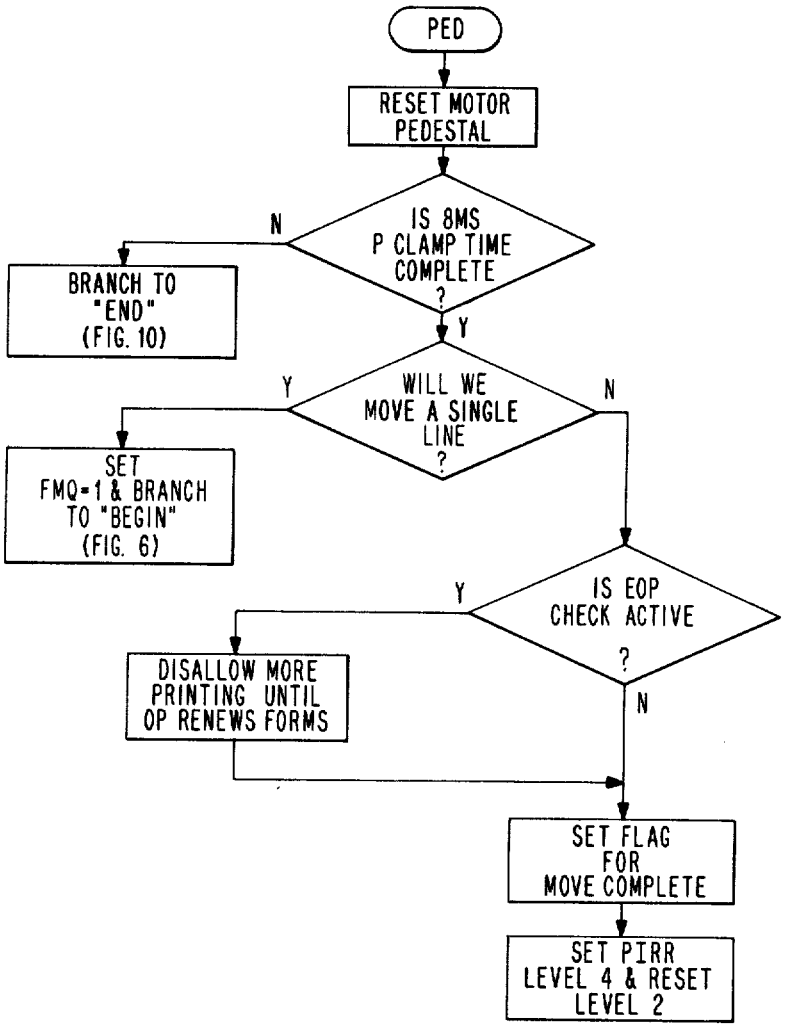
FIG. 7 is a flow diagram of the PED branch routine.

At the end of the 1 millisecond Pedestal detent time out, timer 1/2 generates an IRQ3 interrupt, checks the timers and proceeds to branch to the PED routine of FIG. 7.

In the PED routine, MPU 10 resets the motor pedestal and checks the 8 millisecond clamp time complete. If the motion is complete, MPU 10 performs an EOP check and then sets a flag indicating move complete to set PIRR at level 4 and resets level 2. If the carriage drive has moved all lines except the last line, MPU then sets the forms move quantity to one then branches to BEGIN which initiates the same procedure as previously described feeding the forms one additional line space. The END routine is the same for the last line as previously described.

Figure 8:
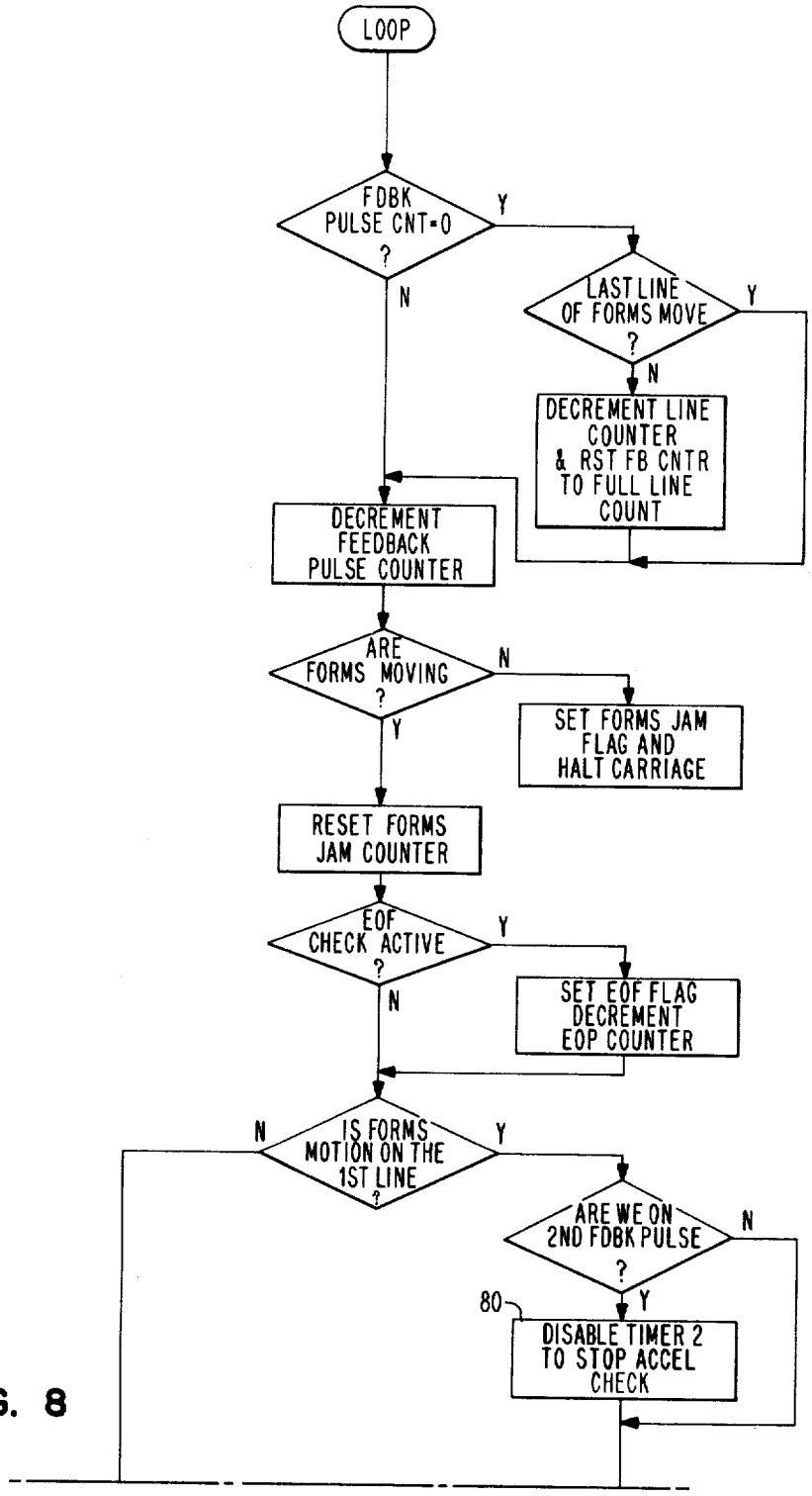
FIGS. 8, 9, & 10 show the LOOP routine.
Figure 9:
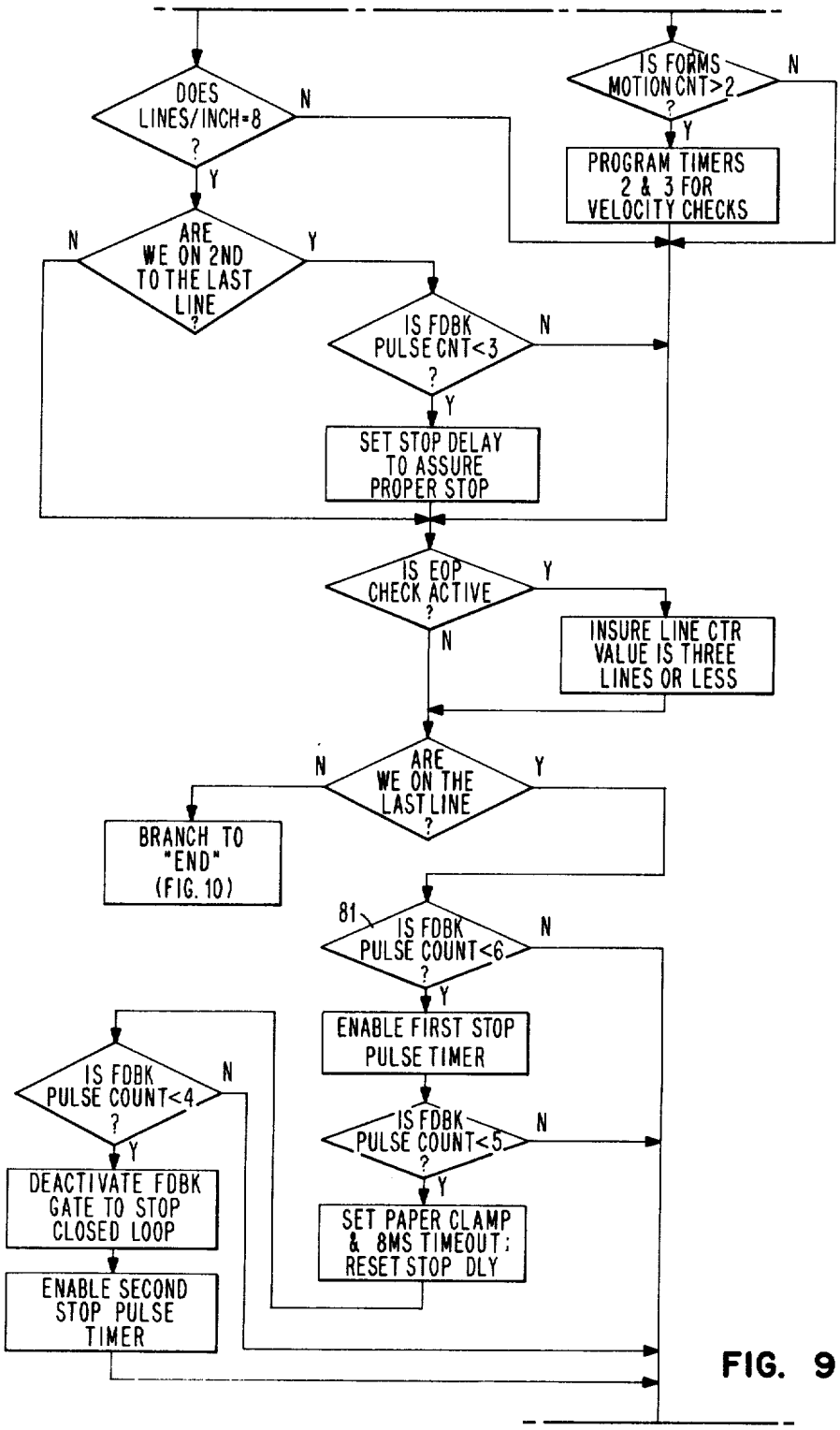

It is to be noted that the END routine in all cases involves checking for a missed feedback pulse. Such an occurrence might happen where MPU 10 has received a feedback pulse from PIA but because of a higher priority or a lower preemptive priority interrupt did not decrement its feedback pulse counter in RAM. In that case, MPU 10 branches to LOOP and processes any pending interrupt request. Basically, the routine for correcting for missed feedback pulses is to check feedback counter, in RAM with counter 57 as shown in FIG. 8, and decrementing the counter in RAM to correct for a missed feedback pulse. At the END routine, the feedback pulse counter is compared with the binary counter 57 again to determine whether a second feedback pulse was missed. Should the decrementing of the counter have corrected the error, MPU 10 proceeds with resetting PIRR level 2. If more than one pulse had been missed, MPU 10 will still detect a missed feedback pulse and will branch to LOOP to process the pending IRQ at which time the feedback pulse counter in RAM will be decremented an additional amount to correct for the missed second pulse.

In this manner carriage control will proceed without disturbance notwithstanding the fact that the MPU 10 was prevented from monitoring the carriage control in accordance with its normal processing routine.

While the invention has been particularly shown and described with reference to preferred embodiments thereof, it will be understood by those skilled in the art that the foregoing and other changes in form and details may be made therein without departing from the spirit and scope of the invention.

We claim:

1. In a printer system having a print mechanism comprising a plurality of non-printing units including a carriage drive for feeding a print medium in increments of one or more line spaces having a drive means and an emitter associated with said drive means for generating feedback pulses during operation of said drive means, a control system for operating said carriage drive comprising in combination, control means comprising a programmable interface to said drive means, said interface including a control adapter programmable for generating various control signals to said drive means and timing means programmable for timing various operations of said drive means for feeding said print medium, said adapter and said timing means being operable for generating processor interrupt signals associated with said timing operations and said feedback pulses, a microprocessor for programmably controlling said drive means through said adapter and said timing means in response to said interrupt signals from said timing means and said feedback pulses, said microprocessor being responsive to other interrupt signals from other devices in said printer system during operation of said drive means including interrupt signals capable of preempting said microprocessor from control of said drive means, and means for preventing the loss of control of said drive means by said microprocessor resulting from interrupt signals from said other devices.

2. In a printer system in accordance with claim 1 in which said means for preventing loss of control includes a control counter for counting said feedback pulses continuously throughout the feed operation of said drive means.

3. In a printer system in accordance with claim 2 in which said means for preventing loss of control includes a second counter operable by said microprocessor for counting said feedback pulses, and means for making periodic comparison of said second and said control counter for detecting feedback pulses missed by said microprocessor.

4. In a printer system in accordance with claim 3 in which said timing means includes a plurality of timers individually programmable by said microprocessor for timing various operations of said drive means, said timers being resettable by said control counter.

5. In a printer system in accordance with claim 4 in which said timers are programmable and resettable for checking start, acceleration, velocity and deceleration operations of said drive means.

6. In a printer system in accordance with claim 5 in which said drive means is a stepper motor operable by start and stop pulses from said timers and said feedback pulses.

7. In a printer system in accordance with claim 4 in which said periodic comparison for detecting missed feedback pulses is performed by said microprocessor in accordance with an END routine associated with control of said various operations of said drive means by said microprocessor.

8. In a printer system in accordance with claim 7 in which said microprocessor is operated in accordance with a LOOP routine for correcting said second counter in the event said comparison detected a missed feedback pulse.

9. In a printer system in accordance with claim 7 in which said END routine is performed by said microprocessor in association with checking acceleration, velocity and deceleration operations of said drive means.

10. In a printer system in accordance with claim 1 in which said other devices includes a ribbon drive means controllable by said microprocessor through said adapter.

* * * * *